US006840470B2

(12) United States Patent
Bankes et al.

(10) Patent No.: US 6,840,470 B2
(45) Date of Patent: Jan. 11, 2005

(54) REFINER FORCE SENSOR

(75) Inventors: Alan Henry Bankes, Okotoks (CA); Peter Martin Wild, Kingston (CA); Daniel Ouellet, Vancouver (CA); Behrouz Shiari, Markham (CA); Seyed Mohammad Ali Siadat, Burnaby (CA); John Jaa Senger, Vancouver (CA)

(73) Assignees: Pulp and Paper Research Institute of Canada, Pointe-Claire (CA); Queen's University at Kingston, Kingston (CA); University of British Columbia, Vancouver (CA)

( * ) Notice: Subject to any disclaimer, the term of this patent is extended or adjusted under 35 U.S.C. 154(b) by 171 days.

(21) Appl. No.: 09/805,430

(22) Filed: Mar. 14, 2001

(65) Prior Publication Data

US 2001/0032898 A1 Oct. 25, 2001

Related U.S. Application Data

(60) Provisional application No. 60/189,601, filed on Mar. 15, 2000.

(30) Foreign Application Priority Data

Mar. 15, 2000 (CA) ..... 2300737

(51) Int. Cl.[7] ..... B02C 25/00
(52) U.S. Cl. ..... 241/30; 241/261.2; 241/298
(58) Field of Search ..... 241/261.2, 261.3, 241/296, 297, 298, 30

(56) References Cited

U.S. PATENT DOCUMENTS 5,747,707 A * 5/1998 Johansson et al. ..... 241/261.3
6,314,381 B1 * 11/2001 Johansson ..... 241/261.1
6,324,490 B1 * 11/2001 Johansson et al. ..... 700/108

FOREIGN PATENT DOCUMENTS

WO WO 97/38792 10/1997
WO WO 98/48936 11/1998
WO WO 00/78458 12/2000

OTHER PUBLICATIONS

Annu et satt att se pa malningsprocessen (A New Way to Look at the Beating Process), Giertz, Norsk Skogindustria 18(7) :239–248, 1964.
The Beating of Chemical Pulps—the Action and the Effects, Page, Fundamentals of Papermaking, Transactions of the Ninth Fundamental Search Symposium Held at Cambridge, Sep. 1989, vol. 1, pp. 1 to 38.
Force Factors in a Disk Refiner and Their Effect on the Beating Process, Goncharov, English translation, Bum. Promst. 12(5) : 1–14, 1971.
Nordman et al, Conditions in an LC–refiner as observed by Physical Measurements, No. 4, 1981 Paperi ja Puu—Papper oct Tra.
Douglas Atack, Towards a Theory of Refiner Mechanical Pulping, Nov. 1980, Paper presented at 34$^{th}$ Annual Conference, Albury, 1980, Appita vol. 34, No. 3, pp. 223–227.
Gradin et al, Measurement of the Power Distribution in a Single–Disc Refiner, Journal of Pulp and Paper Science : vol. 25, No. 11, Nov. 1999, pp. 384–387.
Atack et alMechanical Reduction of Chips by Double–Disk Refining, Pulp and Paper Magazine of Canada, Paper presented at the Annual Meeting of the Technical Section, Jan. 22–25, 1963, pp. T–75–T–83.

* cited by examiner

*Primary Examiner*—Mark Rosenbaum
(74) *Attorney, Agent, or Firm*—Ogilvy Renault

(57) ABSTRACT

This invention relates to a refiner force sensor for refiners used in the pulp and paper industry, to a refining apparatus, and to a method of measuring force acting on a refiner bar in a refiner.

37 Claims, 16 Drawing Sheets

REFINER FORCE SENSOR

CROSS REFERENCE TO RELATED APPLICATION

This application claims priority from U.S. Provisional Patent Application No. 60/189,601, filed Mar. 15, 2000, and the benefit of 35 U.S.C. 119(e).

BACKGROUND OF THE INVENTION i) Field of the Invention

The present invention relates to a refiner force sensor for refiners used in the pulp and paper industry, to a refining apparatus, and to a method of measuring forces acting on a refiner bar in a refiner.

ii) Description of Prior Art

Refiners are used to produce pulp from wood chips or to modify the mechanical properties of wood fibres by repeatedly applying forces to the material processed by means of bars mounted on two opposing surfaces that move relative to one another.

Refiners are commonly used in the pulp and paper industry to repeatedly subject wood fibres or wood chips to stresses and strains. In the case where wood chips are processed, the purpose is usually to separate wood fibres from one another to produce pulp that can later be used to manufacture paper or composite wood products such as hardboard. This process is generally conducted at high temperature and pressure in a steam environment, because a large amount of steam is produced in the refiner from the heat dissipated while processing the material. Coarse pulps produced in such a way can also be further processed in a similar way to improve some of the properties of fibres. Examples of this are the commonly used practice of subjecting pulp to a second stage of refining, or to screening followed by reject refining. Low-consistency or flow-through refiners are also used to process pulp slurries at consistencies up to approximately 5%. In this case, the aim is generally to stress and strain wood fibres in order to improve some of their properties.

A vast array of operating conditions are used in industrial refining systems, but a number of design features are common to all refiners. Refiner discs are fitted with plates having alternating patterns of bars and grooves. The bars of opposing plates are separated by a small gap that can be adjusted, and at least one of the discs rotates. Pulp travels through a refiner in the form of fibre agglomerates that are repeatedly compressed and sheared between the bars of opposing plates as these travel past each other. Hence, all refiners expend energy on fibres through a repeated application of compression and shear forces acting on fibre agglomerates.

To quantify the effects that these forces have on the individual pulp fibres, some measure of the degree of refining must be taken. Traditionally, this measure has simply been the specific energy, which is the total energy put into the pulp per oven dry mass of fibre. However, it is widely known that this parameter is not sufficient to fully characterize the refining action, since vastly different pulp properties can be obtained at the same level of specific energy under different refining conditions. Several methods have been proposed to use an additional parameter to characterize the action of refiners. The additional parameter usually aims to quantify the severity of bar impacts. This is achieved in different ways with each method, but the severity of bar impacts is generally expressed as a specific energy per impact. However, energy-based characterizations have shortcomings when it comes to identifying the mechanisms by which refining occurs. Energy can be expended on pulp fibres in numerous ways and the method of energy application—the forces—can have a substantial influence on the final pulp properties. Giertz, H. W. ("A new way to look at the beating process", *Norske Skogindustri* 18(7):239–248, 1964) suggested that different refining effects could be explained by the relative magnitude of the forces applied. Similarly, Page, D. H. ("The beating of chemical pulps—The action and the effects", In *Fundamentals of Papermaking: Transactions of the Fundamental Research Symposium held at Cambridge*, F. Bolam editor, Fundamental Research Committee, British Paper and Board Makers' Association, Volume 1, pp. 1–38, 1989), has suggested that a complete understanding of the refining process would require knowledge of the average stress-strain history of individual fibres.

Early work on forces focused on measuring the pressure on refiner bar surfaces. Two of these studies were in low-consistency applications (Goncharov, V. N., "Force factors in a disk refiner and their effect on the beating process", English translation, *Bum. Promst.* 12(5):12–14, 1971; and Nordman, L., Levlin, J. -E., Makkonen, T., and Jokisalo, H., "Conditions in an LC-refiner as observed by physical measurements", *Paperi ja Puu* 63(4): 169–180, 1981), while one was at high consistency (Atack, D., "Towards a theory of refiner mechanical pulping", *Appita Journal* 34(3): 223–227, 1980). The harsh conditions that exist within the refining zone of commercial refiners have proven too severe for standard pressure sensors. These generally fail within a few minutes of operation in these conditions.

Despite the shortcomings of standard pressure sensors, a method has been proposed by Karlström (International Patent Publication No. WO 97/38792) to use them, in conjunction with temperature sensors, to regulate the operation of high-consistency chip refiners. In the control scheme proposed, the mass flow rate of chips and the dilution water flow rate to the refiner, as well as the pressure applied to regulate the gap between refining discs, are adjusted in response to measured values of pressure and temperature in the refining zone. The aim of the method is to control the temperature and the pressure profile across the refining zone in order to maintain desired values of these parameters. WO 97/38792 also claims a method to control specific pulp properties by raising or lowering the temperature in the refining zone. In International Patent Publication No. WO 98/48936, Karlstrom proposes an arrangement of such temperature and pressure sensors for installation in a refiner. WO 97/38792 and WO 98/48936 relate only to the chip refining process.

The pressure measured in the way prescribed by the above method is not due directly to mechanical forces imposed on pulp in the refining zone. It is rather due to the presence of steam produced as a result of the large amount of mechanical energy expended in the refiner that is dissipated as heat. While the steam pressure depends on the amount of energy dissipated locally in the refining zone, it is also strongly dependent on the ease with which steam can escape the refiner along the radial direction.

U.S. Pat. No. 5,747,707 of Johansson and Kjellqvist proposed the use of one or more sensor bars in a refiner. The sensor bars are equipped with strain gauges to measure the load at a number of points along their length. By mounting several strain gauges at each point, the authors suggest that the stresses on a bar can be divided into load components acting in different directions. The apparatus can also include temperature gauges that can be used to compensate the measured stresses for thermal expansion of the bar. In another embodiment, the apparatus includes means for controlling refining in response to the load determined by the sensors.

A sensor bar with a design similar to the one described in the above U.S. patent was used by Gradin et al. (Gradin, P. A., Johansson, O., Berg, J. -E., and Nystrom, S., "Measurement of the power distribution in a single-disc refiner", J. Pulp Paper Sci., 25(11):384–387, 1999) to measure the distribution of the expended power in the refining zone of a single-disc refiner. The authors found that the power expended per unit area was approximately constant over the radius of the refining zone. This confirmed an earlier finding of Atack, D., and May, W. D. ("Mechanical reduction of chips by double-disc refining", Pulp Paper Mag. Can. 64 (Conv. issue): T75–T83, T115, 1963). In order to improve the sensitivity of the sensor bar, the latter was manufactured out of aluminum. This choice of material is inadequate for long-term operation in an industrial refiner, since the sensor bar would wear much faster than the other refiner bars made of hardened material.

SUMMARY OF THE INVENTION

In accordance with a broad aspect of the present invention there is provided a force sensor for measuring force acting on a refiner bar of a refiner for producing or processing wood pulp, said force sensor comprising: a sensor body having a sensor head; and at least one sensor element in force transmission contact with the sensor body, wherein said at least one sensor element produces a signal indicative of the magnitude of force acting on a refiner bar of a refiner for producing or processing wood pulp.

In some embodiments, the refiner bar is on a refiner plate. The refiner plate comprises a refining surface having refiner bars, and a non-refining surface opposed to the refining surface. However, the invention is also applicable to refiners wherein refiner bars are not on a refiner plate.

In some embodiments, the sensor head replaces a portion of the refiner bar. In other embodiments, the sensor head replaces all of the refiner bar. In such embodiments, the sensor body is of the same material as the refiner bar, and the sensor head has a profile matching that of the refiner bar.

According to the invention, the sensor body may be attached to the refining surface of the refiner plate. In some embodiments the sensor body is adapted to fit into a recess in the refining surface of the refiner plate. In other embodiments, the sensor body may be attached to the non-refining surface of the refining plate. In yet other embodiments, the sensor body may be adapted to fit into a recess in the non-refining surface of the refining plate.

In a preferred embodiment, two or more sensor elements are provided, and the sensor body floats on the sensor elements. In some embodiments two or more sensor elements are provided, and the sensor body floats on the sensor elements such that the only link between the sensor body and the refiner plate is through the sensor elements. In yet other embodiments, the force sensor further comprises a holder, and two or more sensor elements are provided, and the sensor body floats on the sensor elements such that the only link between the sensor body and at least one of the refiner plate and the holder is through the sensor elements.

In some embodiments the at least one sensor element is piezo electric, or piezo-ceramic.

In accordance with another aspect of the invention there is provided a method of measuring forces acting on a refiner bar of a refiner for producing or processing wood pulp, the method comprising: providing a sensor body having a sensor head such that the sensor head replaces all or a portion of the refiner bar; disposing at least one sensor element in force transmission contact with the sensor body; refining wood particles or wood pulp in said refiner to produce wood pulp or refined wood pulp, such that force is applied to the sensor head and a signal indicative of the force is developed at said at least one sensor element; and evaluating the signal as a measure of the force applied to the sensor body.

In accordance with a preferred embodiment of the invention, the refiner bar is on a refiner plate, the refiner plate comprising a refining surface having refiner bars, and a non-refining surface opposed to the refining surface. In such embodiments the sensor body may be attached to the refining surface of the refiner plate, while in other embodiments, the sensor body may be attached to the non-refining surface of the refiner plate.

In some embodiments, two or more sensor elements are provided, and the sensor body floats on the sensor elements. In other embodiments, two or more sensor elements are provided, and the sensor body floats on the sensor elements such that the only link between the sensor body and the refiner plate is through the sensor elements.

In yet further embodiments, the method further comprises providing a holder for the sensor body and sensor elements, wherein two or more sensor elements are provided, and wherein the sensor body floats on the sensor elements such that the only link between the sensor body and at least one of the refiner plate and the holder is through the sensor elements.

In some embodiments the at least one sensor element is piezo electric, or piezo-ceramic. Preferably, said measured force is at least one force selected from shear force and normal force.

In a further embodiment of the method of the invention, shear force and normal force are measured, said measured forces being used to regulate the operation of a refiner by manipulating one or more variables selected from material feed rate, pulp consistency, refiner motor load, inlet pressure, outlet pressure, plate gap, and rotational speed, such that the ratio of the measured normal and shear forces are maintained constant or within a predetermined range.

In yet another embodiment, said measured force is used to detect contact between opposing discs in a refiner. Contact between opposing discs is corrected by retracting an axially moveable plate of said refiner.

In the above embodiments, a single force sensor or an array of force sensors can be employed.

BRIEF DESCRIPTION OF THE DRAWINGS

Embodiments of the invention will be described, by way of example, with reference to the drawings, wherein.

DESCRIPTION OF PREFERRED EMBODIMENTS WITH REFERENCE TO THE DRAWINGS

Figure 1:
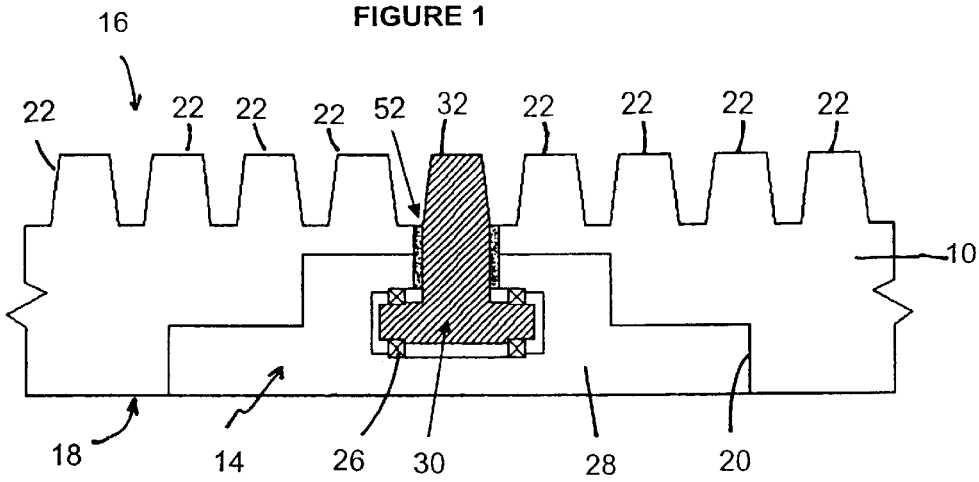
FIG. 1 shows a cross section of a refiner force sensor according to an embodiment of the invention.

The present invention relates to a force sensor for measuring forces acting on a refiner bar in an operating refiner. A refiner force sensor according to the present invention can be used in any type of mechanical refiner used to apply force to wood pulp or wood chips. Examples of such refiners are chip refiners and low-consistency pulp refiners. These can be, for example, single disc, double disc, or conical disc refiners. A single force sensor, or an array of force sensors, can be used for various applications, examples of which are described herein, to control or monitor different aspects of the refining process.

The invention will be described primarily with respect to single and double disc refiners, the general structure of such refiners being well known. For example, a typical refiner is described in U.S. Pat. No. 5,747,707 to Johansson et al., which consists of a pair of relatively rotatable refining discs having radial refiner bars extending along at least part of the refining gap between the discs. The teachings of all cited patents and publications are incorporated herein by reference in their entirety.

The design of the present invention includes several improvements over the prior devices and methods. For example, the use of a piezo electric sensor element, (e.g., a piezo-ceramic sensor element), results in a force sensor with high output voltage, less sensitivity to electrical noise, and greater dynamic range, relative to previous designs such as that of Johansson et al. in U.S. Pat. No. 5,747,707, in which strain gauges were employed as sensor elements. Further, the design proposed in U.S. Pat. No. 5,747,707 is impractical for several reasons. For instance, there must be sufficient deformation of the refiner bar associated with the sensor element to obtain a reliable signal from the sensor element. At the same time, the refiner bar associated with the sensor element must have very similar mechanical properties to other refiner bars on the refiner plate. Such deformation is achieved through use of appropriate material and design of the refiner bar. If the refiner bar is too rigid, the deformations involved are too small to be measured reliably when strain gauges are used as sensor elements. An analysis conducted by certain of the present inventors has shown that a sensor design based on strain gauges and using steel as refiner bar material is indeed impractical from this standpoint.

To overcome problems of the design proposed in U.S. Pat. No. 5,747,707, the refiner bar can be made more compliant by using a material with a lower elastic modulus, as was done by Gradin et al. (above), or by modifying the shape or dimensions of some components of the refiner bar. However, deformation at the tip of the refiner bar must remain small relative to the distance between the bars on the opposing refiner plate, otherwise the forces measured at the sensor bar will not be representative of the true forces between refiner bars. Also, the use of different material for the refiner bar introduces errors because such different material has different physical properties (e.g., hardness, wear resistance, thermal expansion coefficient) relative to the material used for other refiner bars on the refiner plates. Further, increasing the compliance of the refiner bar might have a negative side effect of reducing the first resonant frequency of the force sensor. As discussed below, this resonant frequency must be much higher than the bar passing frequency in the refiner, otherwise vibrations of the refiner bar will affect the measured forces. The inventors has also shown that it is in practice impossible to reconcile all these requirements with a design based on strain gauges as sensing elements.

Sensor Description

In accordance with a broad aspect of the present invention there is provided a force sensor for measuring forces on a refiner bar of a refiner, such as a refiner used for producing and/or processing wood pulp. A force sensor according to the invention comprises a sensor body having a sensor head, and one or more sensor elements in force transmission contact with the sensor body. As described in detail below, the sensor body and one or more sensor elements are attached to a refiner plate, such that the sensor head replaces all or a portion of a refiner bar on the refining surface of a refiner plate.

As used herein, the term "force transmission contact" is intended to mean contact between the sensor body and sensor elements that facilitates transmission of any force received by the sensor body to the sensor elements. Preferably, force transmission contact provides transmission of forces to the sensor elements without any attenuation or distortion of the properties of the forces (e.g., amplitude, frequency, and phase). However, in most cases some attenuation or distortion is unavoidable.

As used herein, the term "sensor element" is intended to mean any transducer that can produce a signal (e.g., an electrical charge or an electrical signal such as voltage or current) in response to loading (e.g., compression). An example of a sensor element is a piezo electric element, such as a piezo-ceramic element. While the invention is described below primarily with respect to piezo electric elements, it is to be understood that the invention is not limited thereto. Suitable piezo electric elements are available from BM Hi-Tech/Sensor Technology Ltd., Collingwood, Ontario. Piezo electric elements selected for relatively high Curie temperature (360° C.), made of lead zirconate titanate (ceramic, e.g., BM500), and measuring about 1 mm×1 mm×7 mm, are preferable. The poling direction is normal to the long axis and one of the short axes. The electrodes are located on opposed surfaces normal to the poling direction. Generally, a thin wire is attached (e.g., soldered) to each of the two electrodes of the piezo electric elements, and these wires are connected to a charge amplifier, as discussed below. An alternative source of piezo electric elements is Piezo Kinetics Incorporated, Bellefonte, Pa. Piezo electric elements made of PKI#502 which has a Curie temperature of 350° C., are suitable. Use of at least two sensor elements will permit both shear and normal forces to be resolved. However, under certain circumstances, both forces can be resolved with only a single sensor element.

The sensor elements are installed in the refiner force sensor such that forces to be measured are applied across two opposed surfaces of the elements. In cases where the electrodes of the piezo electric elements are also on the same opposed surfaces, an insulating layer (i.e., a dielectric material such as mica, cellophane tape, mylar, paper) should be disposed between the opposed surfaces and the sensor components that contact the opposed surfaces. Alternatively, the sensor body and holder and/or refiner plate surfaces can be coated with a thin insulating layer such as vapourdeposited alumina. Piezo electric elements are preferably installed in the force sensor such that forces are applied normal to the poling direction of the sensor elements. The poling direction of piezo electric elements in the embodiments described herein is normal to the two opposed surfaces that contact the force sensor components. However, use alternative orientation of poling direction and electrodes with respect to surfaces that contact the sensor body and holder and/or refiner plate are contemplated.

Forces imparted to the refiner bars of the refiner plate are received by the sensor body via the sensor head, and transmitted to the sensor element(s). As mentioned above, the sensor body is attached to a refiner plate such that the sensor head replaces all or a portion of a refiner bar. Accordingly, the sensor head has a shape or profile that corresponds substantially to that of a refiner bar. Further, the sensor head and/or body is made of the same or similar material as that of a refiner bar, to ensure consistency of mechanical properties (e.g., hardness, wear resistance, thermal expansion coefficient, etc.) across the refiner bars and sensor head.

In some embodiments the sensor assembly comprises the sensor body and one or more sensor elements. In such embodiments the sensor assembly is clamped to a refiner plate with any suitable fastener such as screws. In particular, the sensor elements are clamped between the sensor body and the refiner plate. Such clamping can be achieved, for example, with a screw that directly penetrates the sensor body.

In other embodiments the sensor assembly comprises the sensor body, one or more sensor elements, and a holder. The sensor assembly is attached to a refiner plate via the holder using any suitable fastener. Clamping of the sensor body in force transmission contact with the sensor elements is achieved, for example, by screwing the sensor body to the holder such that the sensor elements are clamped between the sensor body and the holder. However, it is preferable that the sensor body is clamped to the holder without directly screwing the sensor body to the holder. For example, the holder can comprise two or more portions between which the sensor body and sensor elements are clamped, the holder portions being clamped together with fasteners such as screws. In such embodiments, the only physical/mechanical link between the sensor body and the refiner plate and/or the holder is through the sensor elements, such that the sensor body "floats" on the sensor elements (see, for example, the embodiments shown in FIGS. 2, 4, 11, 14, 15, and 16, below).

Clamping of the sensor elements between the sensor body and refiner plate and/or holder compresses the sensor elements, advantageously providing a preload to the sensor elements. The preload helps to ensure a stable signal (e.g., reduces noise) from the sensor elements during operation of the force sensor. Further, clamping gives the sensor assembly structural integrity and ensures that a change (e.g., an increase or decrease) in loading does not result in loss of contact between the sensor body and sensor element(s).

For optimal operation in a refiner, the force sensor assembly (i.e., the assembly comprising the sensor body, sensor elements, holder, if present, and hardware such as screws) should have a vibrational behaviour (frequency response) such that it has a first resonant frequency which is much higher than the bar-passing frequency of the bars in the refiner (that is, the frequency with which bars on one of the refiner plates pass by the bars on the other plate). As used herein, the term "optimal operation" is intended to mean operation that produces force data which can be used to resolve the forces produced at a refiner bar during each bar passing. Depending upon factors such as the design of the refiner, the design of the refining plates, and the position of the plates, the bar passing frequency in a typical commercial refiner varies between about 20 kHz and about 50 kHz. Whereas in theory the first resonant frequency of the force sensor assembly should be as high as possible, relative to the bar passing frequency, physical constraints limit how high the first resonant frequency can be. A first resonant frequency that is about ten times (10×) the bar-passing frequency is expected to be the upper limit for most force sensor designs, and such first resonant frequency is expected to perform fully satisfactorily. On the other hand, a first resonant frequency that is about 1.5 times (1.5×) the bar-passing frequency will produce usable data, but will also produce some noise due to vibration of the sensor body. In general, there are four design principles which can be followed to increase the first resonant frequency:

1. Reduction of the mass of the sensor body;
2. Reduction of the distance from the sensor elements to the center of mass of the sensor body;
3. Selection of a material from which the sensor body is manufactured which has a higher ratio of elastic modulus (stiffness) to density (for example, carbon fiber/epoxy composite has a much higher ratio of elastic modulus to density than steel);
4. Reduction of the compliance of the sensor elements (e.g., piezo electric) by reducing their thickness to the minimum allowed by manufacturing and assembly constraints.

Theoretical procedures such as finite element analysis can be used to determine the resonant frequency of force sensor assemblies. The theoretical values can be measured and confirmed experimentally.

Various embodiments of a force sensor according to the present invention are described below. Throughout FIGS. 1 to 16, common reference numerals refer to the same or similar components of the embodiments described.

Figure 2:
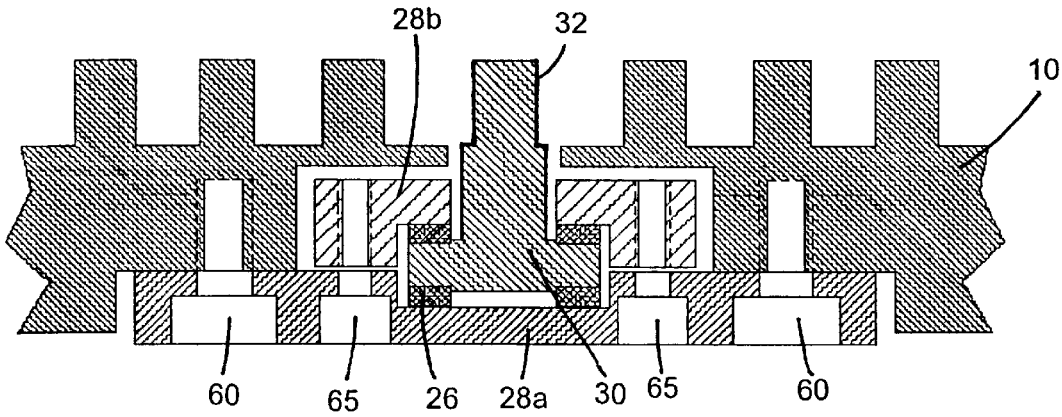
FIG. 2 shows the embodiment of FIG. 1 in greater detail.

With reference to the embodiment of FIGS. 1 and 2, there is shown in cross section a refiner plate 10 comprising a force sensor assembly 14. Refiner plate 10 has a refining face 16, a non-refining face 18 opposed to face 16 and a cavity or recess 20 extending inwardly of face 18. Refiner face 16 has a plurality of refiner bars 22.

Sensor assembly 14 comprises a sensor body 30 and four piezo electric sensor elements 26 disposed in a sensor holder 28. Sensor assembly 14 is disposed in recess 20.

Sensor body 30 has a sensor head 32; sensor head 32 has a profile which matches the profile of the portion of the refiner bar into which it is inserted. That is, the top and side faces of sensor head 32 are substantially flush with the adjacent top and side faces of the refiner bar into which it is inserted. The sensor head 32 thus replaces a short length (e.g., 5 mm) of the refiner bar in which it is inserted and is preferably made of the same material, so that it has the same mechanical properties.

An adhesive filler 52 (e.g., a silicone adhesive) occupies the gap between sensor body 30, refiner plate 10, and sensor holder 28, to prevent contamination of the sensor elements 26 by water, steam, and/or pulp.

The piezo electric sensor elements 26 are disposed between sensor body 30 and sensor holder 28. To facilitate assembly the piezo electric sensors can be bonded to the sensor body, using an adhesive such as, for example, epoxy, however; bonding of the sensors to the sensor body is otherwise unnecessary as clamping the sensor assembly together holds the sensor elements in place. Four piezoelectric elements 26 are used in the embodiment shown in FIG. 1, but designs incorporating any number of sensor elements 26 are understood to be part of the present invention.

As shown in greater detail in FIG. 2, the sensor holder 28 is made of two parts 28*a*, 28*b* held together by fasteners 65. By tightening the fasteners, a preload is applied to the piezo electric sensor elements 26 to ensure that, during operation, the piezo electric elements 26 are always in compression. In addition, this ensures that the sensor elements 26 are in force transmission contact in the holder 28. The sensor holder 28 is fastened within the recess 20 in the non-refining surface 18 of the refining plate 10 with screws 60.

Using finite element analysis, the first natural frequency of the embodiment shown in FIG. 2 was found to be 30 kHz.

Figure 3A:
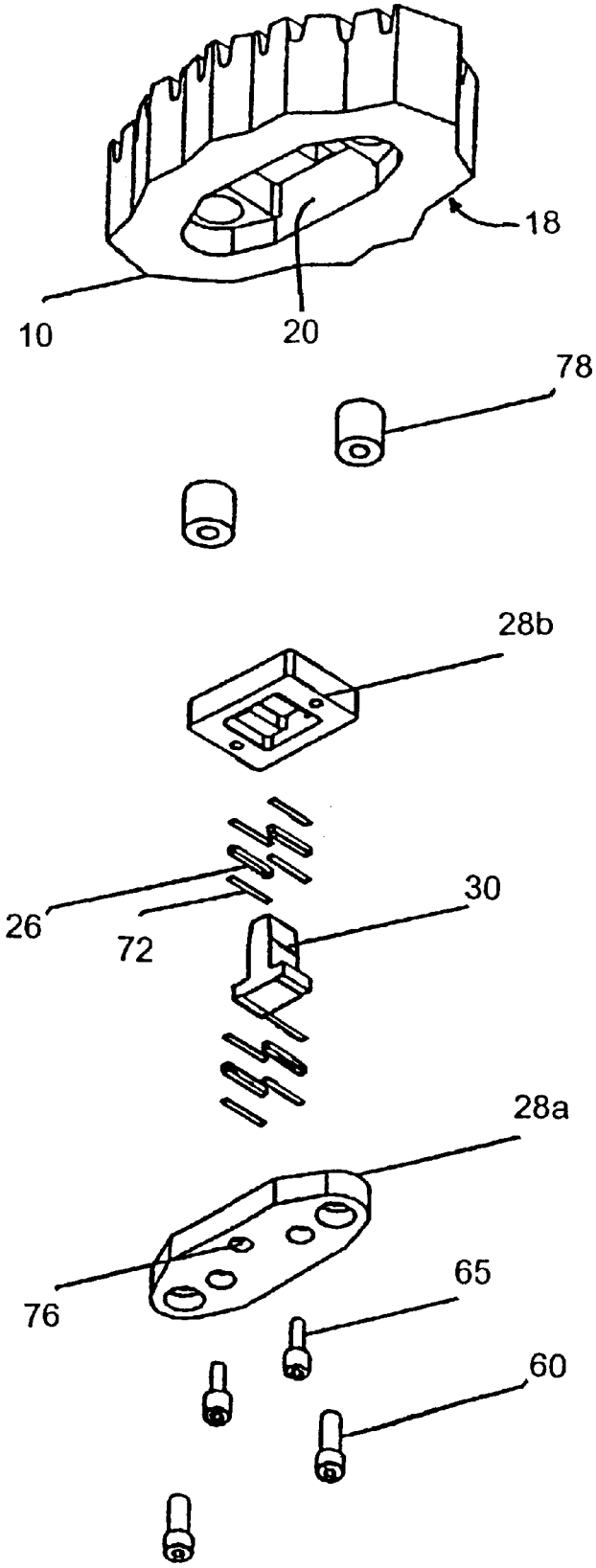
FIGS. 3A and 3B are exploded views of the embodiment shown in FIG. 2.
Figure 3B:
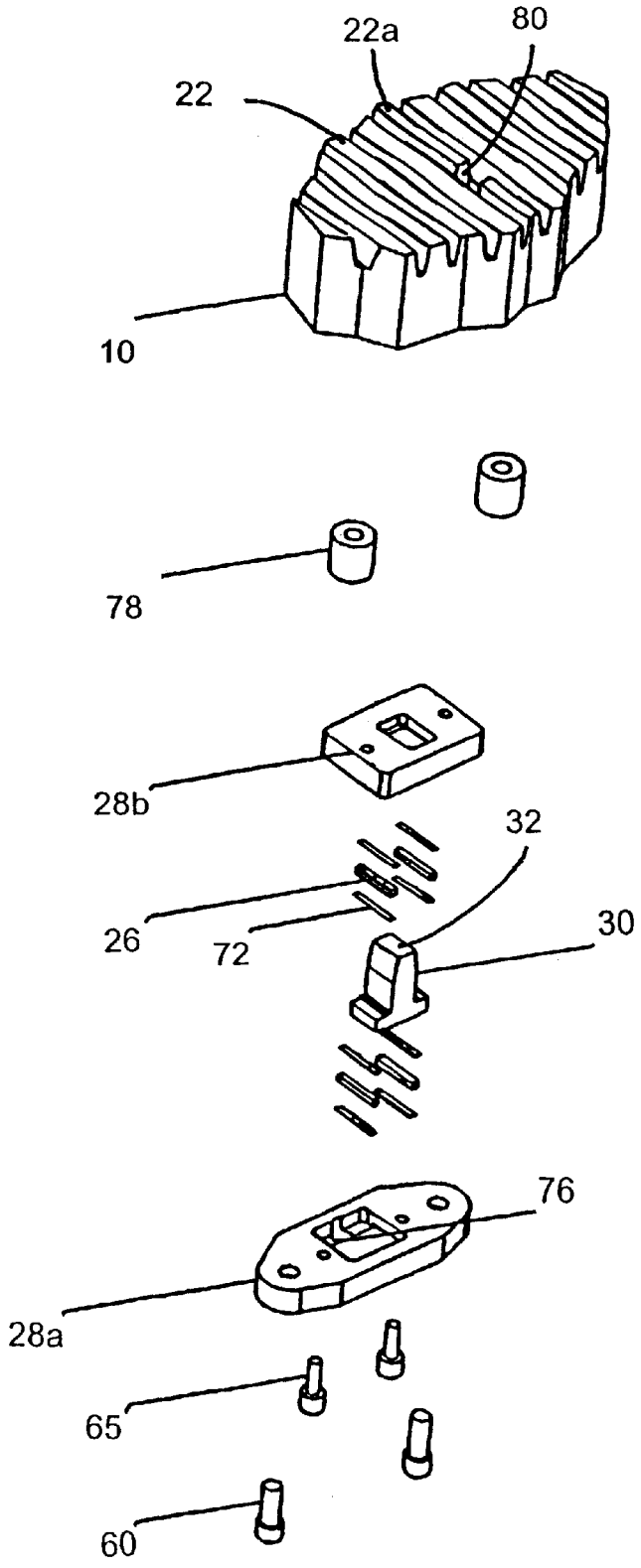

FIGS. 3A and 3B are exploded views of a force sensor assembly such as the embodiment shown in FIG. 2. As shown, thin layers of insulating material 72 such as, for example, mica, are disposed between each of the two opposed surfaces of the piezo electric elements 26, and the surfaces of the holder 28*a*, 28*b* with which they are in contact. If necessary, the insulating layers can be bonded to the piezo electric elements 26 and/or the surfaces of the sensor body 30 and/or holder 28*a*, 28*b* using a suitable adhesive. The insulating layers 72 prevent electrical contact between electrodes on the surfaces of the piezo electric elements 26 and the sensor body 30 and holder 28. The sensor body 30 and piezo electric elements 26 are clamped between the two parts 28*a*, 28*b* of the holder 28 with screws 65. Wires (not shown) from each of the piezo electric elements 26 pass through an orifice 76 in the holder 28*a*.

The force sensor assembly is secured in a recess 20 in the non-refining surface 18 of the refiner plate 10 using screws 60. The recess 20 in the refiner plate 10, if prepared after heat treatment of the refiner plate, can be prepared using any suitable process, such as electro-discharge machining (EDM). Non-heat treated inserts 78 can be pressed into holes prepared by EDM and these inserts can then be tapped to receive the screws 60.

As shown in FIG. 3B, an opening 80 in a refiner bar 22*a* receives the sensor head 32 such that the sensor head 32 replaces a portion of refiner bar 22*a*, and the exposed faces of sensor head 32 are flush with the adjacent faces of the refiner bar 22*a*.

The following alternative embodiments of the refiner force sensor take advantage of the first and second of the above design principles, resulting in higher first resonant frequencies than the embodiment of FIG. 2. Further increases in the first resonant frequency of any of these embodiments can be achieved applying the third and fourth design principles discussed above.

Figure 4:
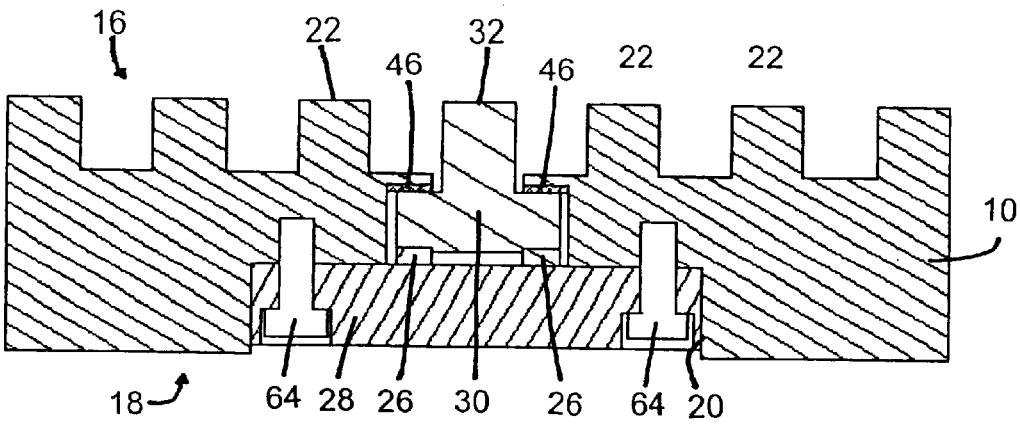
FIGS. 4, 5, and 6 show cross sections of alternative embodiments of a refiner force sensor according the invention.

In the embodiment shown in FIG. 4, the sensor body 30 is T-shaped, as in the embodiments of FIGS. 1 to 3B. Unlike those embodiments, however, the sensor holder 28 no longer encompasses a portion of the sensor body 30, and instead has been reduced to a simple plate. As discussed above, only two piezo electric elements are required to resolve the shear and normal forces applied to the sensor head 32. Thus, in this and the previous embodiments, two of the four sensor elements can optionally be replaced with inactive elements (i.e., elements of the same or different material as the sensor elements, having an effective compliance about the same as that of the sensor elements). For example, in the present embodiment, the two elements 46 are such inactive elements. A preload is applied to the piezo electric elements 26 by screws 64 which also secure the sensor holder 28 in the recess 20 of the refiner plate 10. The inactive elements 46 have sufficient compliance that, when the sensor head 32 is subjected to normal and shear forces, these forces are borne principally by the piezo elements 26. The simplification of the sensor holder 28 facilitates reduced length and mass of the sensor body 30, and thus the distance from the piezo elements 26 to the center of mass of the sensor body 30. These modifications all contribute to a reduction in the first resonant frequency of the force sensor assembly.

Figure 5:
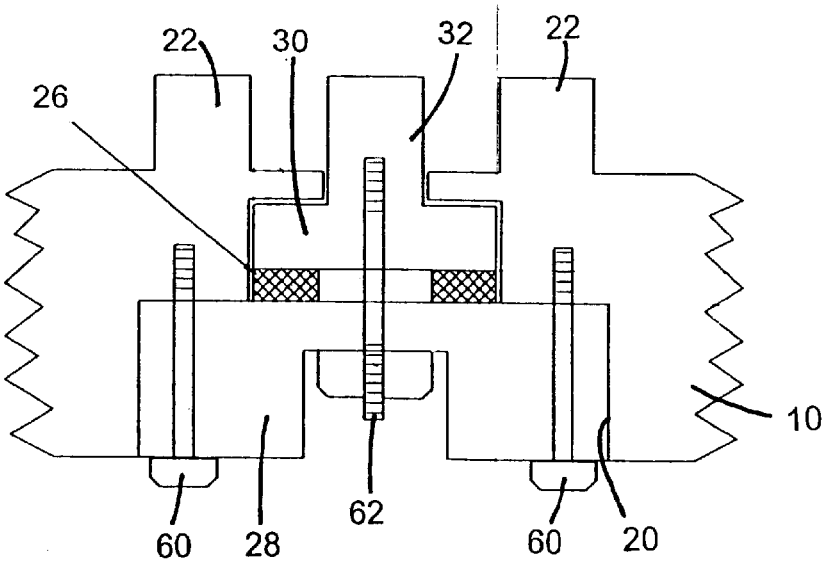

The embodiment shown in FIG. 5 is similar to that of FIG. 4 except that the inactive components 46 are eliminated, and the sensor body 30 is captured by a screw 62, through which a preload is applied to the piezo sensor elements 26. The screw is located on the longitudinal axis of the sensor body 30 (i.e., aligned with the long axis of the refiner bars 22). Screws 60 attach the force sensor assembly in the recess 20 of the refiner plate 10, but do not apply any preload to the sensor elements 26. Some of the shear and normal forces that are received by the sensor head 32 will be transmitted to the sensor holder 28 via the screw 62 rather than via the piezo electric elements 26. It is, therefore, essential that the screw 62 be substantially more compliant (i.e., less stiff) than the piezo elements 26 so that sufficient load is transmitted through the piezo electric elements 26 to ensure that measurable signals are generated.

Figure 6:
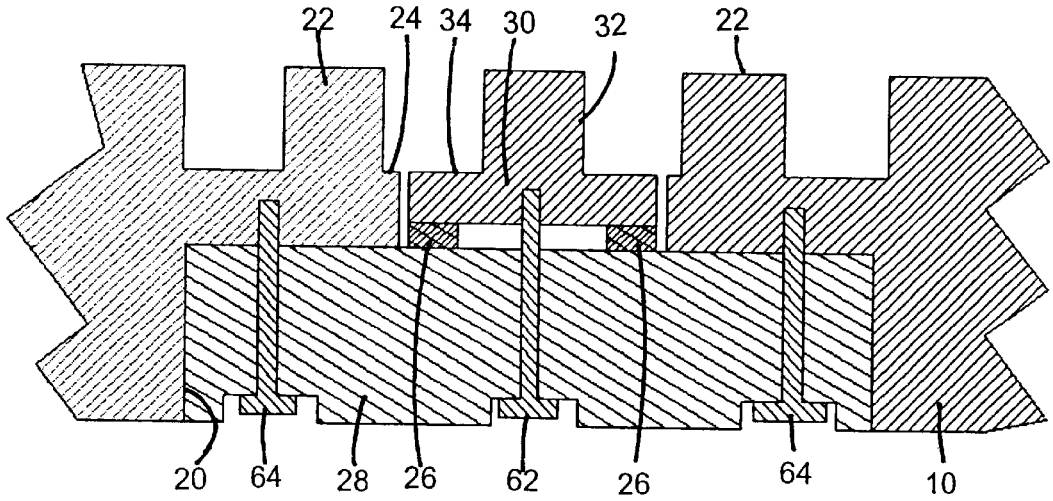

The embodiment shown in FIG. 6 is similar to that shown in FIG. 5 except that the shoulder 34 of the sensor body 30 is flush with the surface of the refiner plate at the base 24 of the grooves between refiner bars 22. This further reduces the length and mass of the sensor body 30 which, in turn, reduces the distance from the piezo elements 26 to the center of mass of the sensor body 30, resulting in a higher first resonant frequency. However, this embodiment has the disadvantage that failure of the screw 62 will cause the sensor body 30 to fall into the refining zone between refiner plates, with substantial damage to the refiner. In the previous embodiments, the sensor body 30 is captured in the refiner plate 10 to prevent movement of the sensor body 30 into the refining zone in the event of failure.

With reference to FIG. 6, this embodiment can be modified by eliminating the holder 28 and the recess 20 in the non-refining surface 18 of the refiner plate 10. Instead, a small recess is provided in the refining surface 16 to accept the sensor body 30 and piezo elements 26. An orifice through refiner plate 10 is provided to accept a screw 62 for securing refiner body 30 in the recess in the refining surface 16. In such modified embodiment, the sensor body 30 is held in position in the refining surface 16 of the refiner plate 10, without the need for a holder 28. However, such embodiment has the same disadvantage as that mentioned above in respect of the embodiment of FIG. 6.

Figure 7:
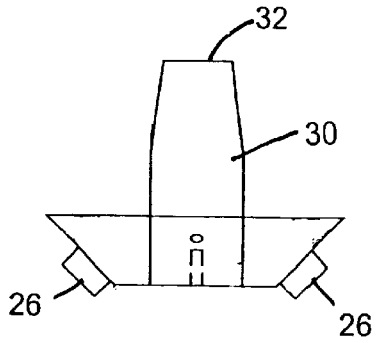
FIG. 7 shows a sensor body and piezo electric elements according to another embodiment of the invention.

FIG. 7 shows an embodiment of sensor body 30, with piezo elements 26, suitable for use in a force sensor similar to that shown any of the previous embodiments. As can be seen in FIG. 7, the sensor body 30 has been modified to accommodate the sensor elements 26 at an angle relative to the surface of refiner plate 10. Corresponding modification of the holder 28 and/or refiner plate 10 of the previous embodiments would therefore be required to accommodate the present sensor body.

As noted above, piezo electric elements are more sensitive to loading which occurs normal to their poling direction. As the poling direction of the piezo electric elements 27 is normal to the two opposed surfaces that contact the sensor components, the angled orientation of the piezo electric elements 27 of this embodiment provides superior resolution of a shear force applied to the sensor head 32.

Figure 8:
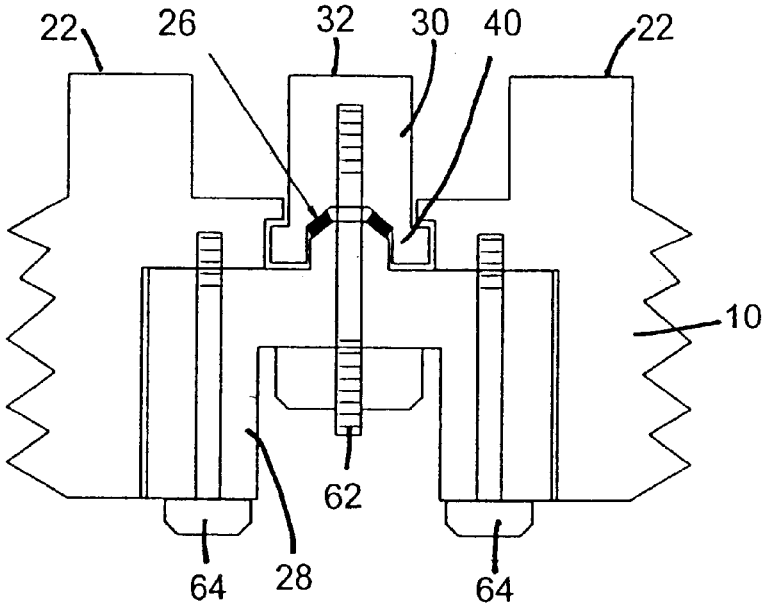
FIGS. 8 to 15 show cross sections of alternative embodiments of a refiner force sensor according the invention.

In the embodiment shown in FIG. 8, the mass of the sensor body 30 has been reduced, relative to that of the previous embodiments. The sensor body 30 is mounted on two piezo electric elements 26 which are positioned at an angle with respect to the surface of the refiner plate 10. As in the previous embodiment, this orientation of the piezo electric elements 26 ensures superior resolution of a shear force applied to the sensor head 32. The sensor body 30 is captured, and preload is applied to the piezo elements 26, with a screw 62 located centrally in the sensor body 30 and holder 28. The sensor body 30 also incorporates tabs 40 which extend under the refining surface of the refiner plate 10. The tabs 40 prevent the sensor body 30 from falling into the refining zone in the event of failure of the screw 62.

Figure 9:
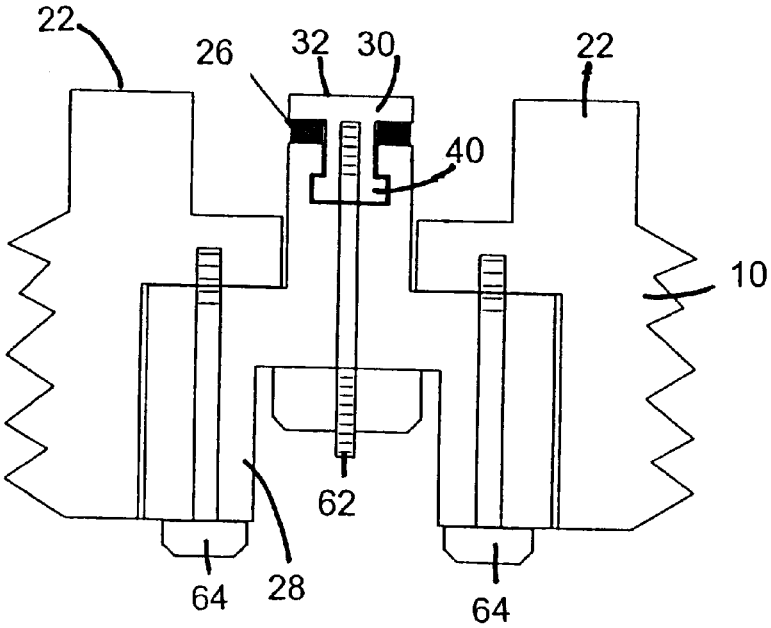

In the embodiment shown in FIG. 9, the mass of the sensor body 30 has been further reduced, with respect to the previous embodiment, by providing a holder 28 that replaces a portion of a refiner bar. The sensor body 30 is mounted on two piezo electric elements 26 which, unlike previous embodiments, are located above the base of the grooves between refiner bars 22 in the refiner plate 10. The sensor body 30 is captured, and preload is applied to the piezo electric elements 26, by a screw 62 located centrally in sensor body 30. The sensor body 30 also incorporates tabs 40 which extend under the upper surface of the refiner plate 10. The tabs 40 prevent the sensor body 30 from falling into the refining zone in the event of failure of the screw 62.

Figure 10:
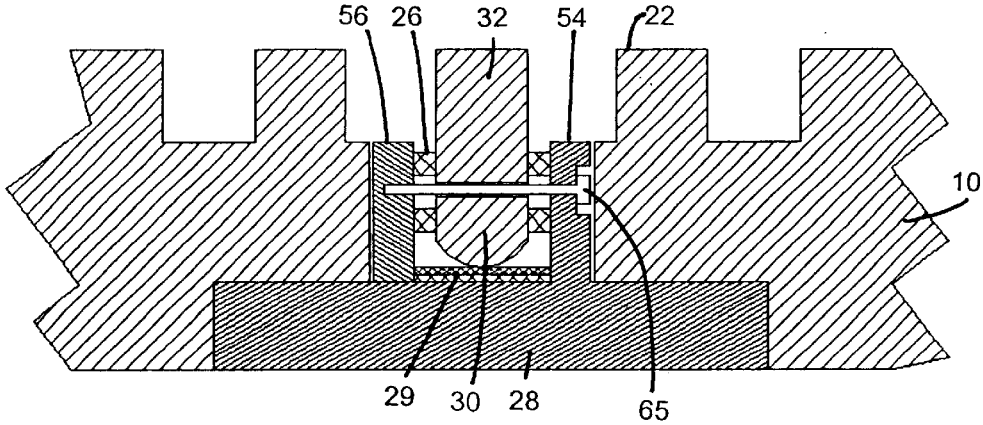

In the embodiment shown in FIG. 10, the sensor body 30 is supported laterally on four piezo electric elements 26 and supported vertically on one piezo electric element 29. The holder 28 comprises a vertical extension 54 and a retaining plate 56. The sensor body 30 and piezo electric elements 26 are clamped between the vertical extension 54 and retaining plate 56 with one or more screws 65, which also applies a preload to the sensor elements.

Figure 11:
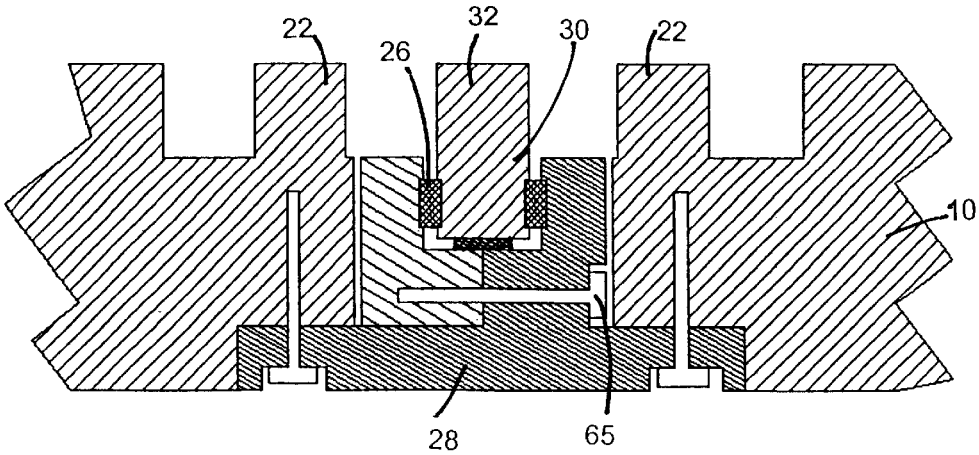

The embodiment of FIG. 11 is similar to that shown in FIG. 10 except that the sensor body 30 is supported laterally on two, rather than four piezo electric elements 26.

Figure 12:
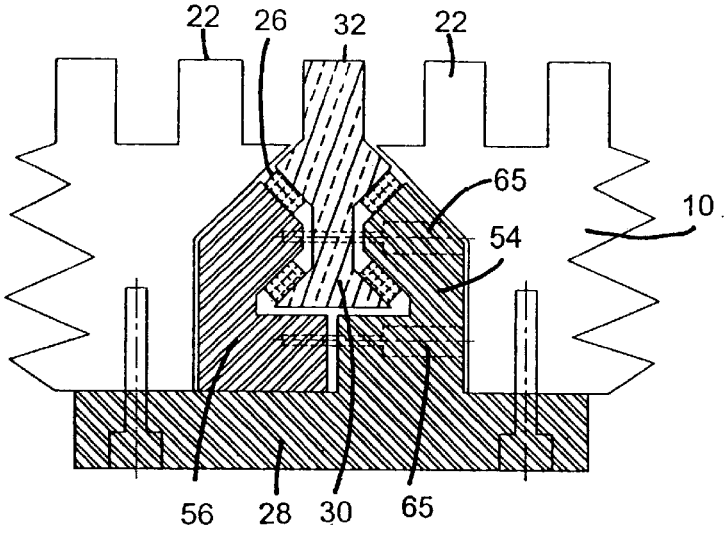

The embodiment of FIG. 12 is similar to that shown in FIG. 10 except that the four piezo elements 26 for are positioned at an angle with respect to the central axis of the sensor body 30, and the piezo electric element 29 at the base of the sensor body 30 has been eliminated. The vertical extension 54 of the sensor holder 28 and the retaining plate 56 have opposed wedge-like profiles. Screws 65 clamp the sensor body 30 between the vertical extension 54 and the retaining plate 56, and apply preload to the sensor elements 26. Also, when the clamping screws 65 are tightened, the wedge profiles ensure that the sensor body 30 and piezo elements 26 are properly located in both the vertical and horizontal directions.

Figure 13:
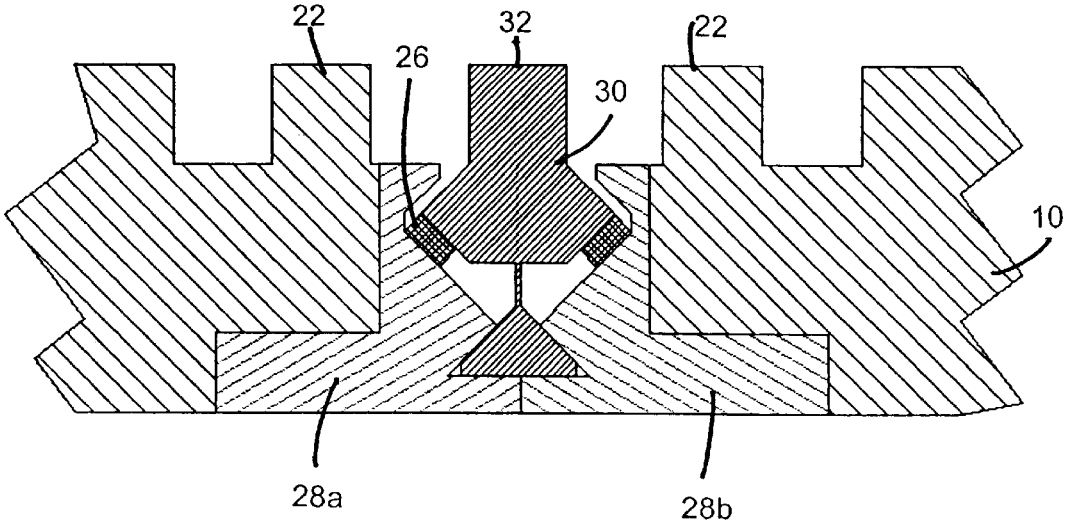

The embodiment of FIG. 13 is similar to that shown in FIG. 12, except that two of the piezo electic elements 26 have been eliminated and the central span of the sensor body 30 has been reduced to a thin web. Also, the sensor holder comprises two portions 28*a*, 28*b*. Upon clamping the sensor body 30 and piezo electric elements 26 between the holder portions 28*a*, 28*b*, this web transfers preload to the upper portion of the sensor body 30, and hence to the sensor elements 26, while being sufficiently flexible that forces applied to the sensor head 32 are transmitted to the piezo electric elements 26.

Figure 14:
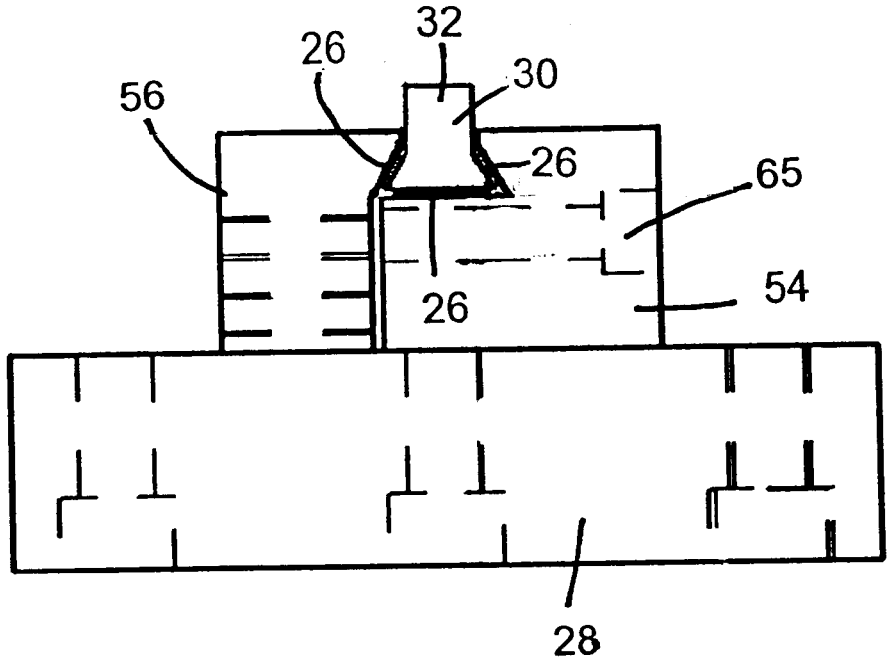

In the embodiment of FIG. 14, which shows a refiner force sensor assembly only, the sensor body 30 is triangular at its base. The sensor body 30 is supported on three piezo electric elements 26. The sensor body 30 and piezo electric elements 26 are captured in a triangular recess in the holder 28, which exists between the vertical extension 54 of the holder 28 and the retaining plate 56. Preload is applied to the sensor elements 26 laterally by one or more screws 65.

Figure 15:
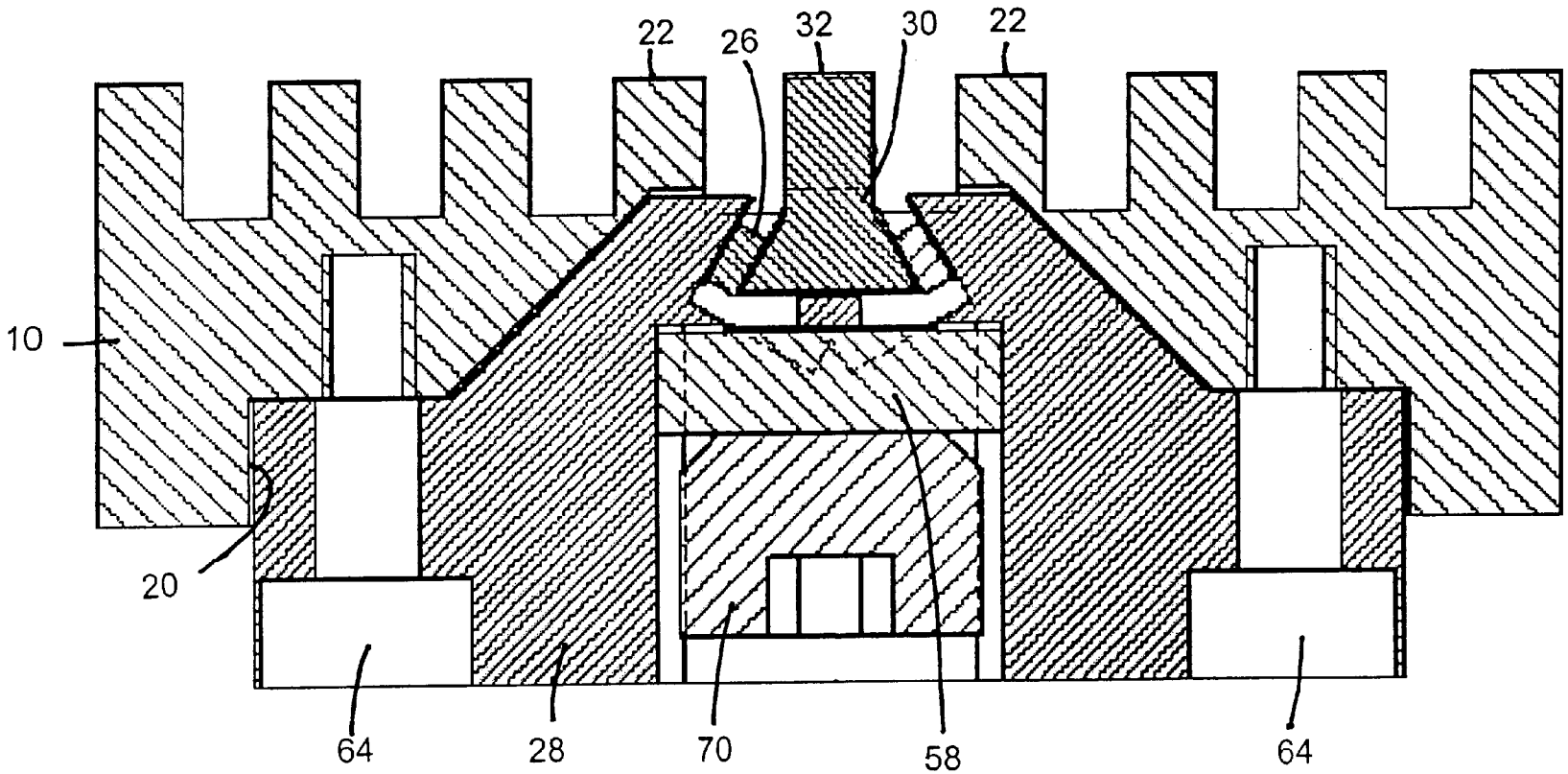
Figure 16:
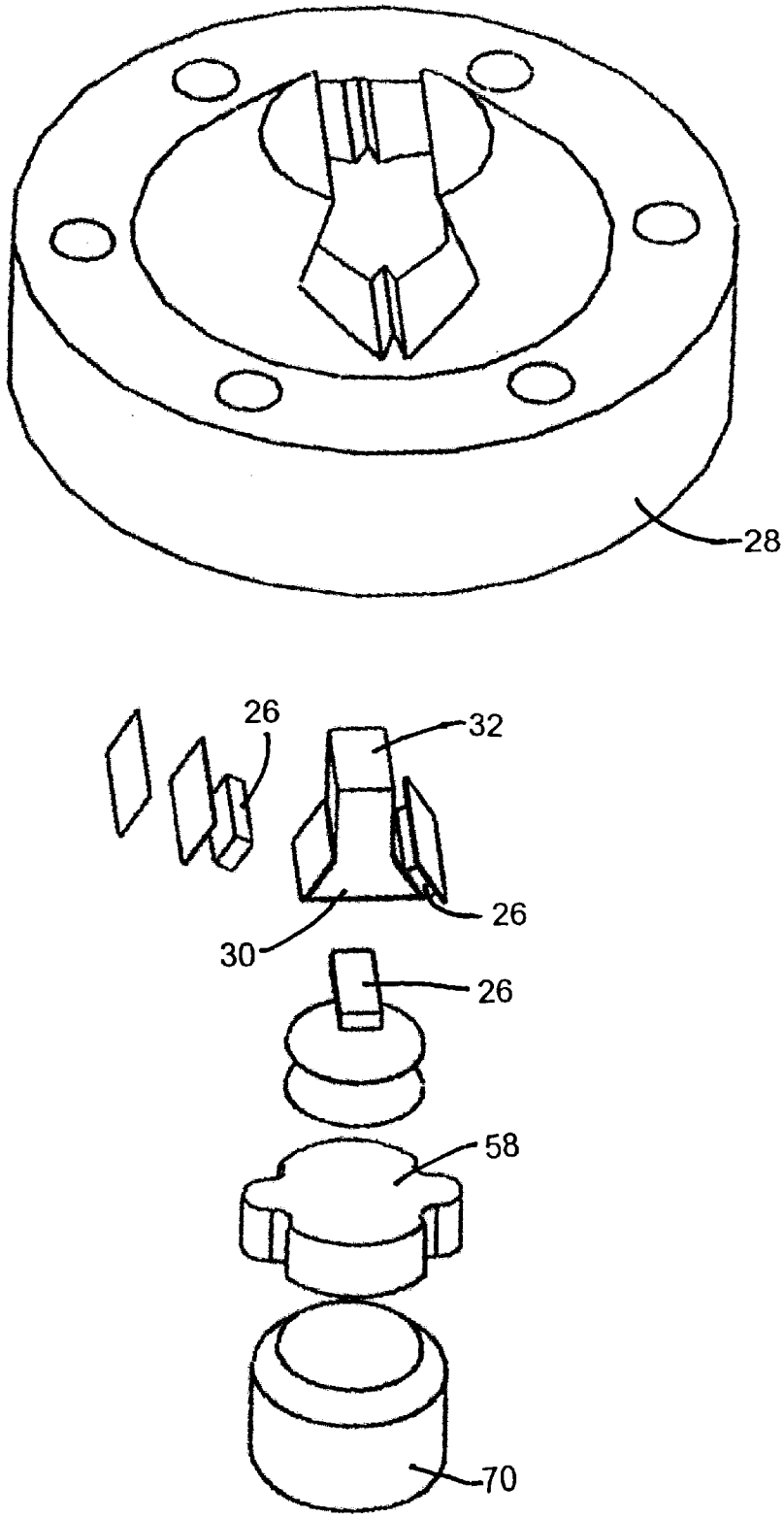
FIG. 16 is an exploded view of the embodiment shown in FIG. 15.

In the embodiment shown in FIG. 15, the sensor body 30 has a triangular base portion similar to that shown in FIG. 14. Sensor holder 28 has a corresponding slotted recess for accepting sensor body 28 and three piezo elements 26. Unlike the embodiment of FIG. 14, the sensor holder 30 of this embodiment does not comprise a vertical extension 54 or retaining plate 56. Instead, set screw 70 and plate 58 are used to clamp the sensor body 30 into the sensor holder 28, and to apply preload to sensor elements 26. That is, tightening set screw 70 forces plate 58 towards the sensor elements 26 and sensor body 30. Plate 58 is tabbed to prevent it from rotating when set screw 70 is turned. The holder 28 is fastened into the recess 20 in the refiner plate 10 with screws 64.

In the embodiments of FIGS. 14 and 15, the piezo electric element 26 below the base of the sensor body 30 can be replaced with an inactive element, as discussed above. The inactive component should have sufficient compliance that, when the sensor head 32 is subjected to normal and shear forces, these forces are borne principally by the remaining two piezo electric elements 26.

As mentioned above, in some embodiments (e.g., those shown in FIGS. 2, 4, 11, 14, 15, and 16), the only physical/mechanical link between the sensor body and the refiner plate and/or the holder is through the sensor elements, such that the sensor body "floats" on the sensor elements. It is noted that in the embodiments of FIGS. 10 and 12, such floating of the sensor body 30 can be achieved if the screw(s) 65 do not contact the sensor body 30. That is, to achieve floating of the sensor body 30, the orifice in sensor body 30 should be of sufficient diameter that screw 65 does not contact sensor body 30.

Sensor Operation

With reference to the embodiments of FIGS. 1 to 16, when normal and shear forces are applied to the sensor head 32, reaction forces are developed at each of the piezo sensor element locations. An electric charge, proportional to the magnitude of the reaction force, is developed by each piezo sensor element 26. The applied normal and shear forces can be determined by measuring and processing the electric signals from each of the piezo sensor elements 26 using appropriate signal conditioning equipment and data analysis.

WORKING EXAMPLE

Figure 17A:
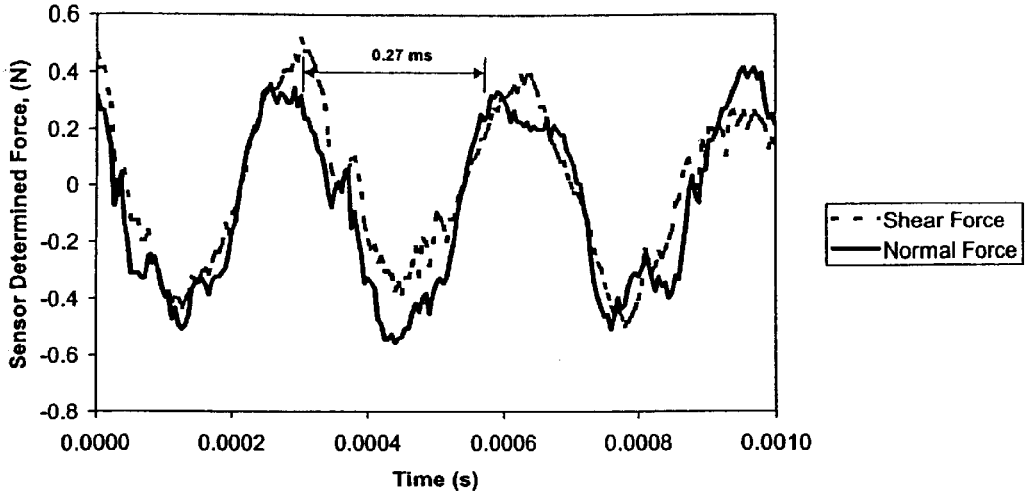
FIGS. 17A, 17B, 18A, and 18B are graphs showing normal and shear forces measured in a refiner using a force sensor according to the embodiment of FIG. 2.
Figure 17B:
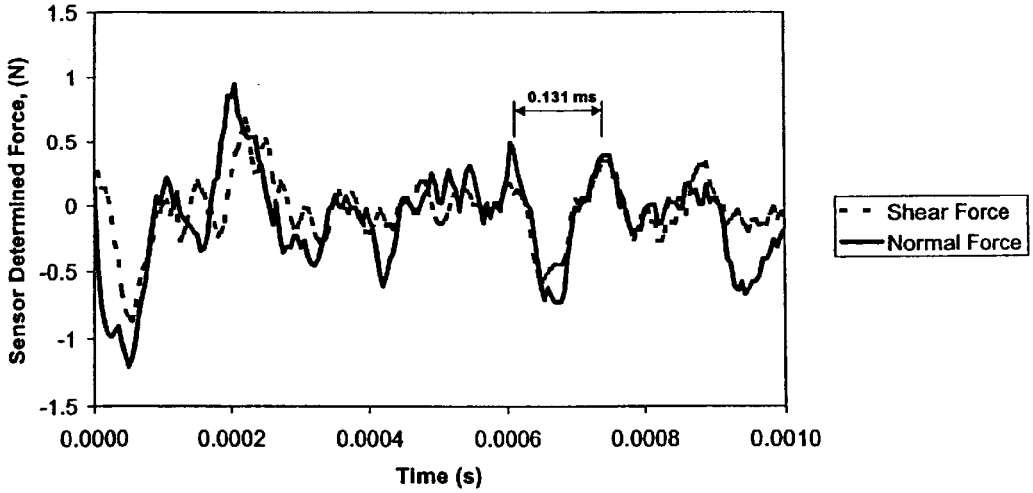

A force sensor according to the embodiment of FIG. 2 was installed in a laboratory refiner. The refiner had a diameter of 30 cm and operated at atmospheric pressure. The refiner was fed with chemi-thermomechanical pulp at a consistency of approximately 20%. FIGS. 17A and B show the normal and shear forces calculated using the signals from two of the piezo-ceramic element sensors 26. In FIG. 17A, the refiner was running at 1260 rpm, corresponding to a period of approximately 270 $\mu$s between bar passings (a bar-passing frequency of about 3.70 kHz). In FIG. 17B the refiner was running at a higher speed of 2594 rpm, corresponding to a bar-passing period of 131 $\mu$s (a bar-passing frequency of about 7.63 kHz). From these results, it can be seen that normal and shear forces related to individual bar crossings can be measured with a force sensor according to the present invention.

The piezo electric elements used in the initial testing above were found to have poor dimensional control. As a result, piezo electric elements having superior dimensional control (Piezo Kinetics Incorporated, Bellefonte, Pa., PKI#502, Curie temperature 350° C.) were incorporated into the force sensor of FIG. 2. This improved tolerances during assembly and provided a more uniform distribution of loading to the sensor elements. In addition, the charge amplifiers used in initial testing, above, which were developed in-house, were replaced with industrial quality charge amplifiers (Kistler Type 5010). These two factors improved the quality of signal obtained from the sensor, as indicated in FIGS. 18A and B.

Figure 18A:
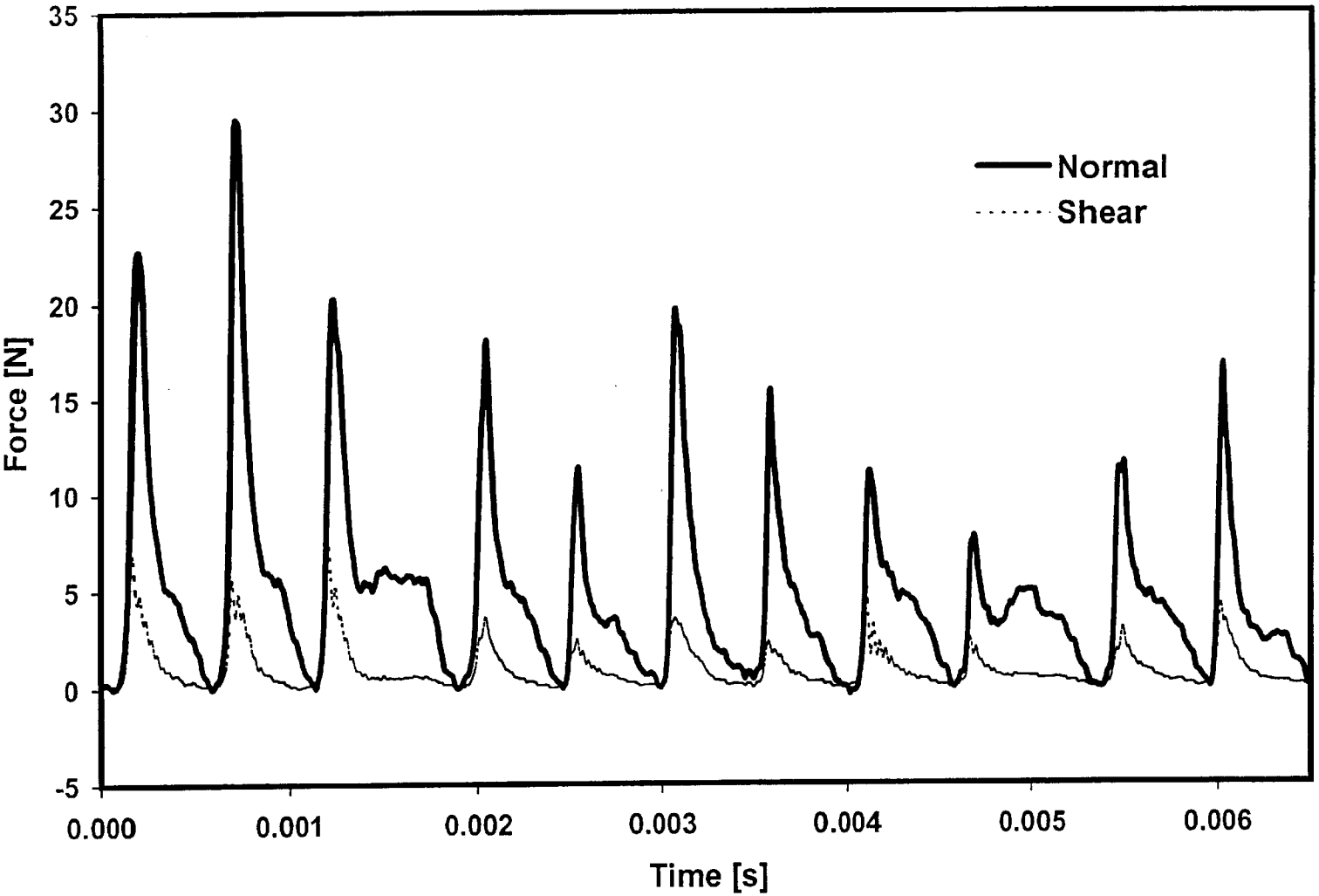
Figure 18B:
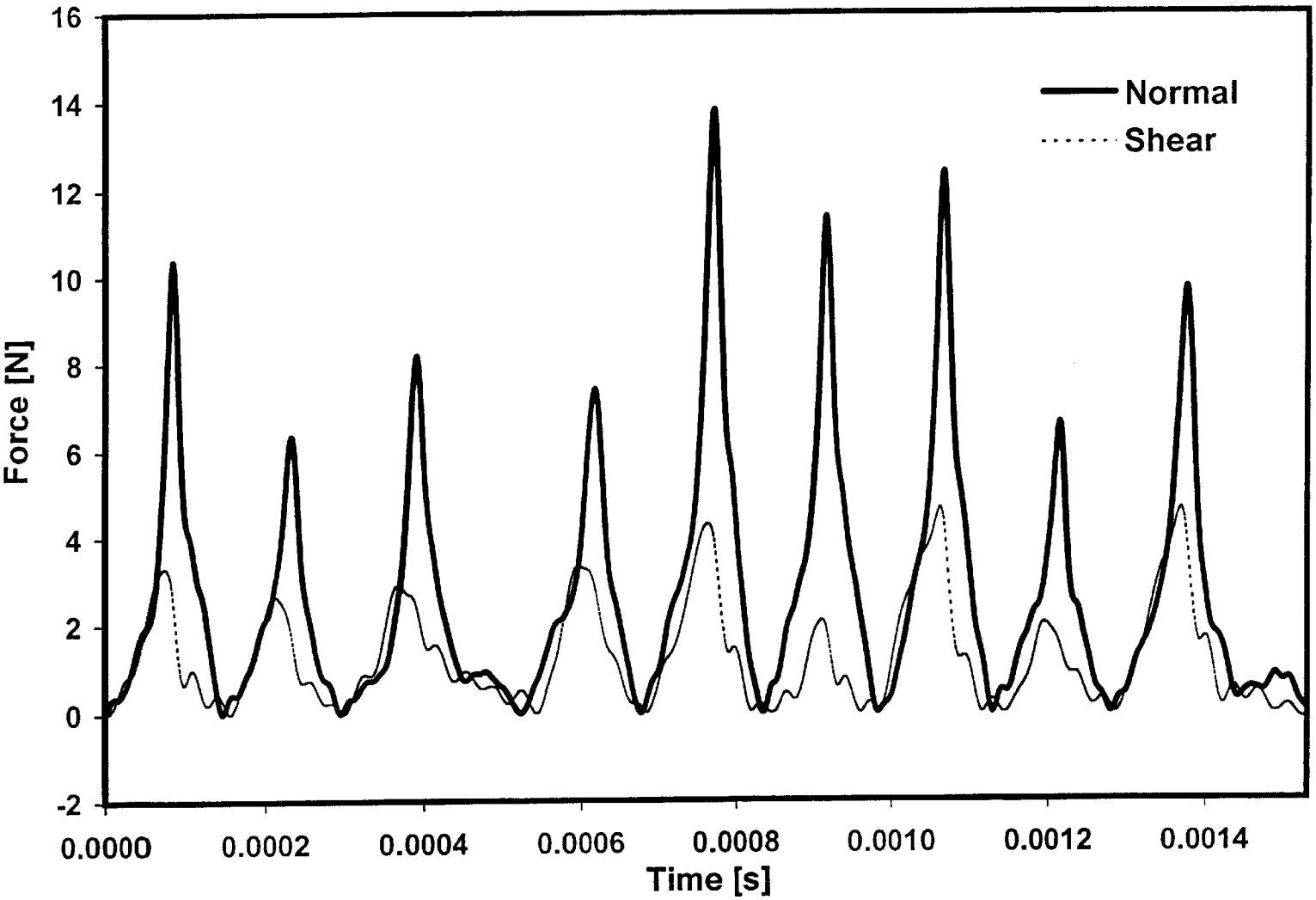

In FIG. 18A, the refiner was running at 700 rpm, corresponding to a bar-passing frequency of about 2.06 kHz. In FIG. 18B the refiner was running at a higher speed of 2600 rpm, corresponding to a bar-passing frequency of about 7.64 kHz. From these results, it can be seen that optimization of the force sensor provides excellent resolution of normal and shear forces related to individual bar crossings.

Measurement System

Figure 19:
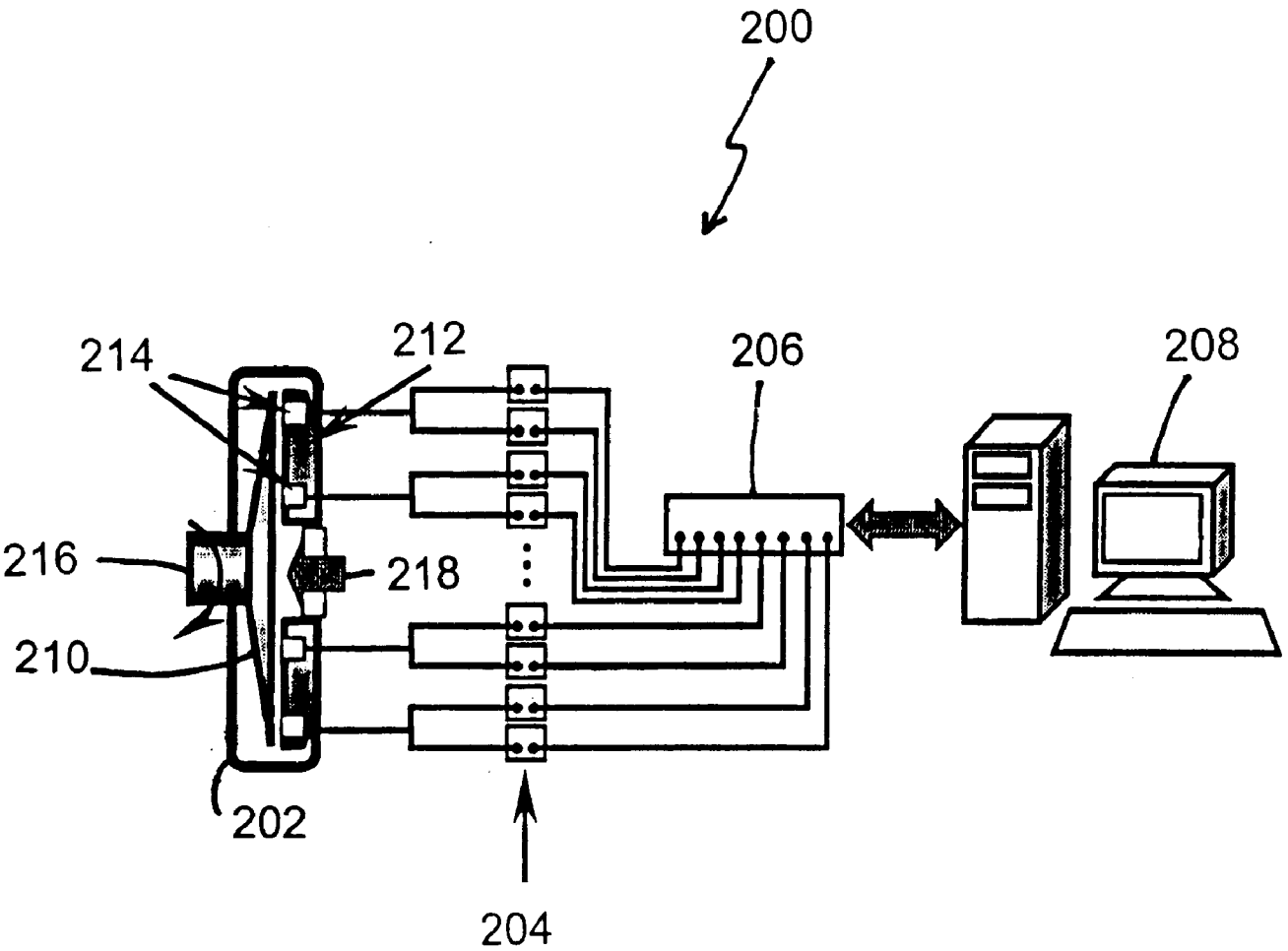
FIG. 19 is a block diagram of a system used to measure forces within a single disc refiner.

With reference to FIG. 19, a refining system 200 comprises a single disc refiner 202, charge amplifiers 204, a data acquisition unit 206 and a computer or controller 208.

Single disc refiner 202 has a rotary disc 210 comprising refiner plates and a stationary disc 212 comprising refiner plates and force sensors 214, according to the present invention, such as the embodiments shown in FIGS. 1 to 15. Each force sensor 214 comprises one or more piezo electric sensor elements as illustrated in the above embodiments.

Refiner 202 has a shaft 216 for rotating disc 210 and a feed inlet 218 for wood chips or wood pulp.

FIG. 19 thus shows the various components of a system used to measure forces within a refiner. The refiner illustrated in FIG. 19 is a single-rotating disc refiner, commonly referred to as a single-disc refiner. Four force sensors are illustrated in FIG. 19, but any number can be used depending on the application. Each piezo electric element of each force sensor is connected to a charge amplifier. The charge amplifiers are connected to the data acquisition unit. In the embodiment shown, the latter can be a digital oscilloscope, analogue to digital converter, or any other means of sampling and digitizing the signals from the charge amplifiers. However, analogue techniques can also be employed to process the force sensor signal(s). The data acquisition unit is connected to the computer via a digital interface, so that the measured data can be transferred for processing to determine the magnitude of the forces on refiner bars of the stationary disc.

Figure 20:
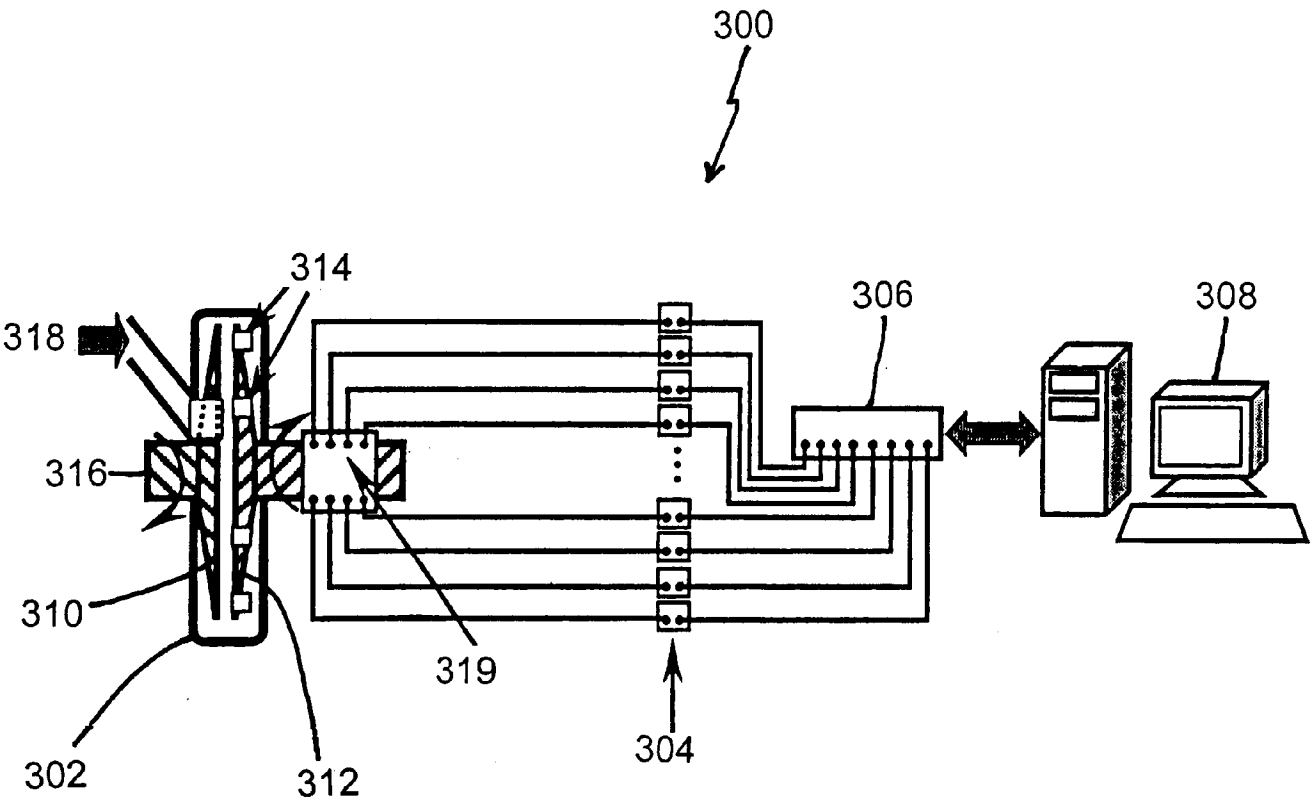
FIG. 20 is a block diagram of a system used to measure forces within a double disc refiner.

FIG. 20 shows a refining system 300 comprising a refiner 302 having a pair of rotating discs 310 and 312, charge amplifiers 304, a data acquisition unit 306 and a computer or controller 308.

Refiner disc 312 comprises refiner plates and a plurality of sensors 314 such as illustrated in the above embodiments. Refiner 302 comprises a shaft 316 for rotating discs 310 and 312, and a feed inlet 318 for wood chips or wood pulp.

A slip ring unit 319 provides connection between the sensors 314 and the charge amplifiers 304.

Thus FIG. 20 illustrates an arrangement for a case where the forces on refiner bars are measured on a rotating disc, such as would be the case in a refiner where both discs are rotating (e.g., a double-disc refiner). In this case, wires from the force sensors are brought through the shaft of the refiner to a slip-ring unit. This unit allows the transfer of electrical signals from a rotating part to a non-rotating part, or vice-versa. The rest of the measurement system is similar to the one described in FIG. 19. In a variation of the system illustrated in FIG. 20, the charge amplifiers are mounted on the rotating shaft of the refiner, and the amplified signals are fed to the data acquisition unit through the slip-ring unit. In the latter case, the slip-ring unit can also be eliminated by transferring the amplified signals using a non-contact transmitter-receiver system.

Applications

A number of applications have been identified for the present invention and are briefly described hereinafter. Any of these applications may require a single force sensor or an array of force sensors at a number of locations within the refining zone of a refiner. Except where otherwise specified, these applications refer both to refining of wood chips or wood fragments for the production of pulp using mechanical means or the use of a refiner to modify some properties of wood fibres or pulp.

a) A single force sensor, or an array of force sensors, can be used to measure the magnitude of the normal force, acting perpendicular to the plane of the refiner bar surfaces, and the shear force, acting in the plane of the refiner bar surfaces. The relative magnitude of the normal and shear forces affects the action of the refiner on the material processed and can be adjusted by changing the feed rate of material to the refiner, the solids content of the material fed, the plate gap in the refiner, or the rotational speed of the refiner. By manipulating the refiner operating conditions so as to maintain a constant ratio between the shear and the normal forces in response to changes caused by process upsets, a more uniform refining action can be maintained.

b) A single force sensor, or an array of force sensors, can be used to detect contact between two opposing refiner plates (plate clash). Specific features of the force signals can be monitored to detect such contact, and corrective action can be taken to preserve the integrity of the refiner plates and avoid premature wear, such as, for example, retracting the axially moveable plate of the refiner.

c) The magnitude of the measured forces in a refiner depends, among other things, on the amount of material present between the refiner bars and the distance between the face of the intersecting bars (plate gap). When the mass flow rate of material fed to a refiner changes, due for example to process upsets or non-uniform quality of the feed material, the amount of material present between refiner bars can also change. A single force sensor, or an array of force sensors, in conjunction with a suitable means to measure plate gap in the refiner, can be used to detect such changes and take corrective action.

d) In refiners having multiple co-axial refining zones, such as for example, twin refiners, conical disc refiners, multidisc refiners, Duoflo refiners, and the like, an arrangement of sensors can be used to measure the relative magnitude of forces between different refining zones. The sensors can be used as part of a control system to regulate the flow of material or the plate gap in each refining zone in order to maintain predetermined optimal operating conditions.

Equivalents

Those skilled in the art will recognize variants of the embodiments described herein. Such variants are within the scope of the present invention and are covered by the appended claims.

We claim:

1. A force sensor for use in measuring force acting on a refiner bar of a refiner plate in a refiner for producing or processing wood pulp, said force sensor comprising:

a sensor head for receiving force imparted to said refiner bar;

a sensor body for receiving force from said sensor head; and at least one sensor element in force transmission contact with the sensor body, wherein said at least one sensor element, in use, produces a signal indicative of the magnitude of force acting on the refiner bar.

2. The force sensor of claim 1, wherein the sensor body is of the same material as the refiner bar.

3. The force sensor of claim 1, wherein the sensor head has a profile matching that of the refiner bar.

4. The force sensor of claim 1, wherein two or more sensor elements are provided, and the sensor body floats on the sensor elements.

5. The force sensor of claim 1, wherein said at least one sensor element is piezo electric.

6. The force sensor of claim 1, wherein the at least one sensor element is piezo-ceramic.

7. The force sensor of claim 1, wherein said measured force is at least one force selected from shear force and normal force.

8. The force sensor of claim 1, wherein the force sensor has a first resonant frequency that is at least about 1.5 times greater than a bar passing frequency of the refiner.

9. A method of measuring force acting on a refiner bar of a refiner plate of a refiner for producing or processing wood pulp, the method comprising:

providing a sensor body having a sensor head, the sensor head adapted to replace all or a portion of the refiner bar of the refiner plate;

disposing at least one sensor element in force transmission contact with the sensor body;

refining wood particles or wood pulp in said refiner to produce wood pulp or refined wood pulp, such that force is applied to the sensor head and a signal indicative of die force is developed at said at least one sensor element, and evaluating the signal as a measure of the force applied to said refiner bar.

10. The method of claim 9, wherein two or more sensor elements are in force transmission contact with said sensor body, and floating the sensor body on the sensor elements.

11. The method of claim 9, wherein two or more sensor elements are in force transmission contact with said sensor body, and floating the sensor body on the sensor elements such that the only link between the sensor body and the refiner plate is though the sensor elements.

12. The method of claim 9, further comprising providing a holder for the sensor body and sensor elements, wherein two or more sensor elements are in force transmission contact with said sensor body, and floating the sensor body on the sensor elements such that the only link between the sensor body and at least one of the refiner plate and the holder is through the sensor elements.

13. The method of claim 9, wherein said step of disposing comprises disposing at least one piezo electric sensor element in force transmission contact with the sensor body.

14. The method of claim 9, wherein said step of disposing comprises disposing at least one piezo-ceramic sensor element in force transmission contact with the sensor body.

15. The method of claim 9, wherein said measured force is at least one force selected from shear force and normal force.

16. The method of claim 9, wherein shear force and normal force are measured, said measured forces being used to regulate the operation of a refiner by manipulating a variable selected from material feed rate, pulp consistency, refiner motor load, inlet pressure, outlet pressure, plate gap, and rotational speed, such that the ratio of the measured normal and shear forces are maintained constant or within a predetermined range.

17. The method of claim 16, wherein said shear force and normal force are measured with an array of force sensors.

18. The method of claim 9, wherein said measured force is used to detect contact between opposing discs in a refiner.

19. The method of claim 18, wherein said shear force and normal force are measured with an array of force sensors.

20. The method of claim 18, wherein contact between opposing discs is corrected by retracting an axially moveable plate of said refiner.

21. The method of claim 9, further comprising:

disposing two or mote sensor elements in compressive preload between the sensor body and the refiner plate such that said sensor elements are in force transmission contact with the sensor body.

22. The method of claim 9, further comprising:

disposing two or more sensor elements;

providing a holder for the sensor body and sensor elements, wherein said sensor elements are in compressive preload between the sensor body and at least one of the refiner plate and the holder.

23. A refining member for producing or processing wood pulp comprising a refiner plate having refiner bars thereon, and a force sensor for measuring force acting on a first of said refiner bars, said force sensor comprising a sensor head replacing at least part of the first refiner bar, for receiving force imparted to said first refiner bar, a sensor body for receiving force from said sensor head; and at least one sensor element in force transmission contact with the sensor body for producing a signal indicative of the magnitude of force acting on said first refiner bar.

24. A refining member of claim 23, wherein the refiner plate comprises a refining surface having refiner bars, and a non-refining surface opposed to the refining surface.

25. A refining member of claim 24, wherein the sensor body is attached to the refining surface of the refiner plate.

26. A refining member of claim 24, wherein the sensor body fits into a recess in the refining surface of the refiner plate.

27. A refining member of claim 24, wherein the sensor body is attached to the non-refining surface of the refining plate.

28. A refining member of claim 24, wherein the sensor body fits into a recess in the non-refining surface of the refining plate.

29. A refining member of claim 23, wherein the sensor head replaces a portion of the refiner bar.

30. A refining member of claim 23, wherein the sensor head replaces all of the refiner bar.

31. A refining member of claim 30, wherein the sensor body is of the same material as the refiner bar.

32. A refining member of claim 30, wherein the sensor head has a profile matching that of the refiner bar.

33. A refining member of claim 23, wherein said force sensor comprises two or more sensor elements, and the sensor body floats on the sensor elements such that the only link between the sensor body and the refiner plate is though the sensor elements.

34. A refining member of claim 23, further comprising a holder, said force sensor comprising two or more sensor elements, and wherein the sensor body floats on the sensor elements such that the only link between the sensor body and at least one of the refiner plate and the holder is through the sensor elements.

35. The refining member of claim 23, further comprising:

at least two sensor elements in compressive preload between the sensor body and the refiner plate, such that said sensor elements are in force transmission contact with said sensor body.

36. The refining member of claim 23, further comprising:

at least two sensor elements; and a holder for said sensor body and said sensor elements, wherein said sensor elements are in compressive preload between the sensor body and at least one of the refiner plate and the holder.

37. A method of measuring force acting on one or more refiner bars of a refiner for producing or processing wood pulp, the method comprising:

providing two or more force sensors on one or more refiner bars;

said force sensors each having a sensor head for receiving force imparted to the refiner bars; a sensor body for receiving force from the sensor head; and at least one sensor element in force transmission contact with the sensor body;

refining wood particles or wood pulp in said refiner to produce wood pulp or refined wood pulp, such that force is applied to the sensor heads of said force sensors and signals indicative of said force are developed at said sensor elements, and evaluating the signals as a measure of the force applied to said one or more refiner bars.

* * * * *

UNITED STATES PATENT AND TRADEMARK OFFICE

CERTIFICATE OF CORRECTION

PATENT NO. : 6,840,470 B2
DATED : January 11, 2005
INVENTOR(S) : Alan Henry Bankes et al.

It is certified that error appears in the above-identified patent and that said Letters Patent is hereby corrected as shown below:

Title page,
Item [75], Inventors, add -- Matthew Allan Olmstead, Toronto (CA) -- after "Daniel Ouellet, Vancouver (CA)";

Column 15,
Line 35, substitute -- the -- for "die";
Line 46, substitute -- through -- for "though";

Column 16,
Line 2, substitute -- is -- for "are";
Line 14, substitute -- more -- for "mote";
Lines 47 and 51, substitute -- refiner -- for "refining";
Line 63, substitute -- through -- for "though".

Signed and Sealed this

Twenty-sixth Day of July, 2005

JON W. DUDAS
*Director of the United States Patent and Trademark Office*